US008348594B2

(12) United States Patent
Chen

(10) Patent No.: US 8,348,594 B2
(45) Date of Patent: Jan. 8, 2013

(54) CENTRIFUGAL FAN

(75) Inventor: Rung-An Chen, Taipei Hsien (TW)

(73) Assignee: Foxconn Technology Co., Ltd., New Taipei (TW)

( * ) Notice: Subject to any disclaimer, the term of this patent is extended or adjusted under 35 U.S.C. 154(b) by 725 days.

(21) Appl. No.: 12/604,414

(22) Filed: Oct. 23, 2009

(65) Prior Publication Data

US 2011/0058938 A1 Mar. 10, 2011

(30) Foreign Application Priority Data

Sep. 4, 2009 (CN) ..... 2009 1 0306604

(51) Int. Cl.
*F04D 29/42* (2006.01)
*F04D 29/62* (2006.01)

(52) U.S. Cl. ..... 415/102; 415/204; 415/206; 415/214.1; 415/229

(58) Field of Classification Search ..... 415/101, 415/102, 204, 206, 213.1, 214.1, 229; 417/352–354, 417/423.15
See application file for complete search history.

(56) References Cited

U.S. PATENT DOCUMENTS 1,978,459 A * 10/1934 Hegan ..... 415/204
3,627,442 A * 12/1971 Brandt ..... 415/214.1
4,199,302 A * 4/1980 Goettl ..... 415/206
2009/0067991 A1* 3/2009 Hwang et al. ..... 415/214.1

* cited by examiner

*Primary Examiner* — Christopher Verdier
(74) *Attorney, Agent, or Firm* — Altis Law Group, Inc.

(57) ABSTRACT

A centrifugal fan includes an impeller and a housing receiving the impeller therein. The impeller includes a hub and blades extending radially from the hub. The housing includes a bottom wall, a sidewall extending upwardly from the bottom wall and a bracket for supporting the impeller thereon. The bottom wall defines an air inlet therein. A plurality of protruding posts extend downwardly from a bottom surface of the bottom wall around the air inlet. Each of the protruding posts defines a screw hole therein. The bracket is located in the air inlet. The bracket defines a plurality of through holes corresponding to the protruding posts respectively. The protruding posts of the bottom wall are respectively inserted into the through holes of the bracket. A plurality of bolts are respectively screwed into the screw holes of the protruding posts to connect the bracket and the bottom wall together.

14 Claims, 4 Drawing Sheets

CENTRIFUGAL FAN

BACKGROUND

1. Technical Field

The disclosure relates to heat dissipation fans, and particularly to a centrifugal fan for dissipating heat generated by an electronic component.

2. Description of Related Art

Electronic components operating at high speed generate excessive heat which must be removed efficiently to ensure normal operation. Typically, a fan is used in combination with a heat dissipation device to produce an airflow in order to remove heat from the electronic components. Many portable electronic systems, such as a laptop computer or a notebook computer, are crammed with electronic components. There is little free space inside the computer. Accordingly, a centrifugal fan which requires only a small space for installation is generally used.

The centrifugal fan includes a housing and an impeller received in the housing. The housing is usually made of plastic material. An air inlet is defined in a central portion of a bottom wall of the housing. A bracket is located in the air inlet for supporting the impeller thereon. The bracket requires higher strength, and is usually made of metallic material. The bracket includes a chassis, a tube extending upwardly from the chassis, and a plurality of ribs extending outwardly from an outer periphery of the chassis. A through hole is defined in a distal end of each of the ribs. A plurality of screw holes corresponding to the through holes of the ribs are defined in the bottom wall of the housing around the air inlet. The bracket is connected to the housing via bolts, which are respectively extended through the through holes of the ribs and screwed into the screw holes of the bottom wall. The impeller is mounted around the tube of the bracket via a shaft rotatably received in the tube.

During operation of the centrifugal fan, the impeller rotates at high speed to generate an airflow. The impeller is liable to cause the bracket to vibrate with respect to the bottom wall of the housing. Since the housing is made of plastic material and the bottom plate is usually thin, each screw hole is short, and only a few turns of a screw thread can be formed on an inner wall of the screw hole. Thus, after the bolts are screwed into the screw holes, only a few turns of a screw thread of each bolt can engage with the screw thread of the corresponding screw hole. This means the bolts may easily disengage from the screw holes of the bottom wall when the centrifugal fan has operated for a long time.

It is thus desirable to provide a centrifugal fan which can overcome the described limitations.

DETAILED DESCRIPTION

Reference will now be made to the drawings to describe the present centrifugal fan in detail.

Figure 1:
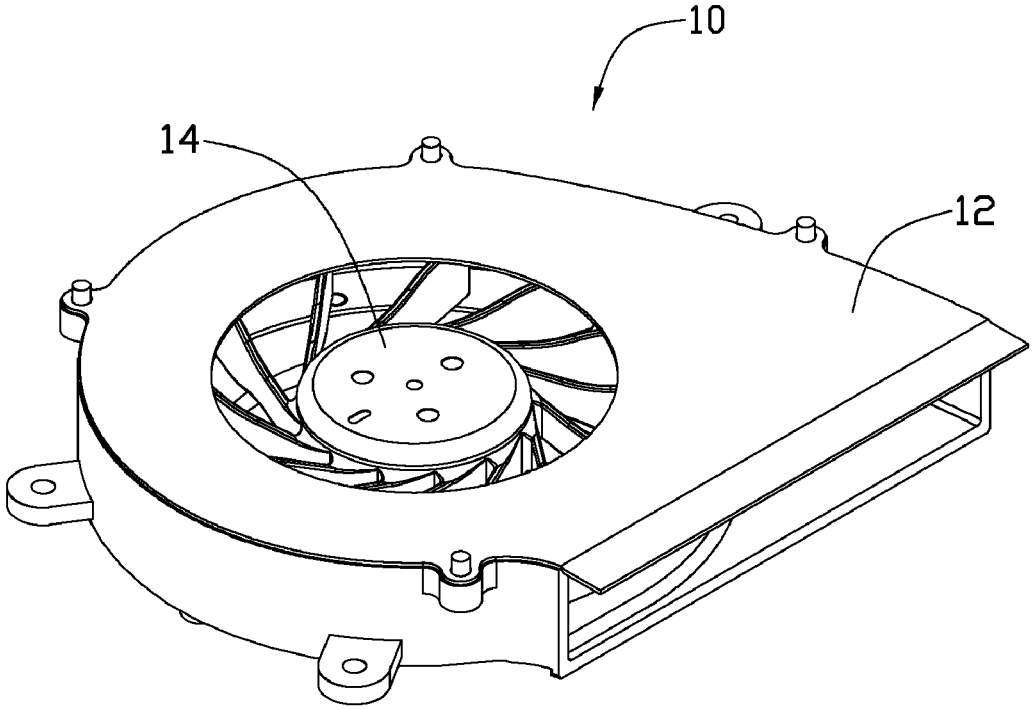
FIG. 1 is an isometric, assembled view of a centrifugal fan according to a first embodiment.

FIG. 1 illustrates a centrifugal fan 10 for dissipating heat generated by an electronic component (not shown). The centrifugal fan 10 includes a housing 12 and an impeller 14 received in the housing 12.

Figure 2:
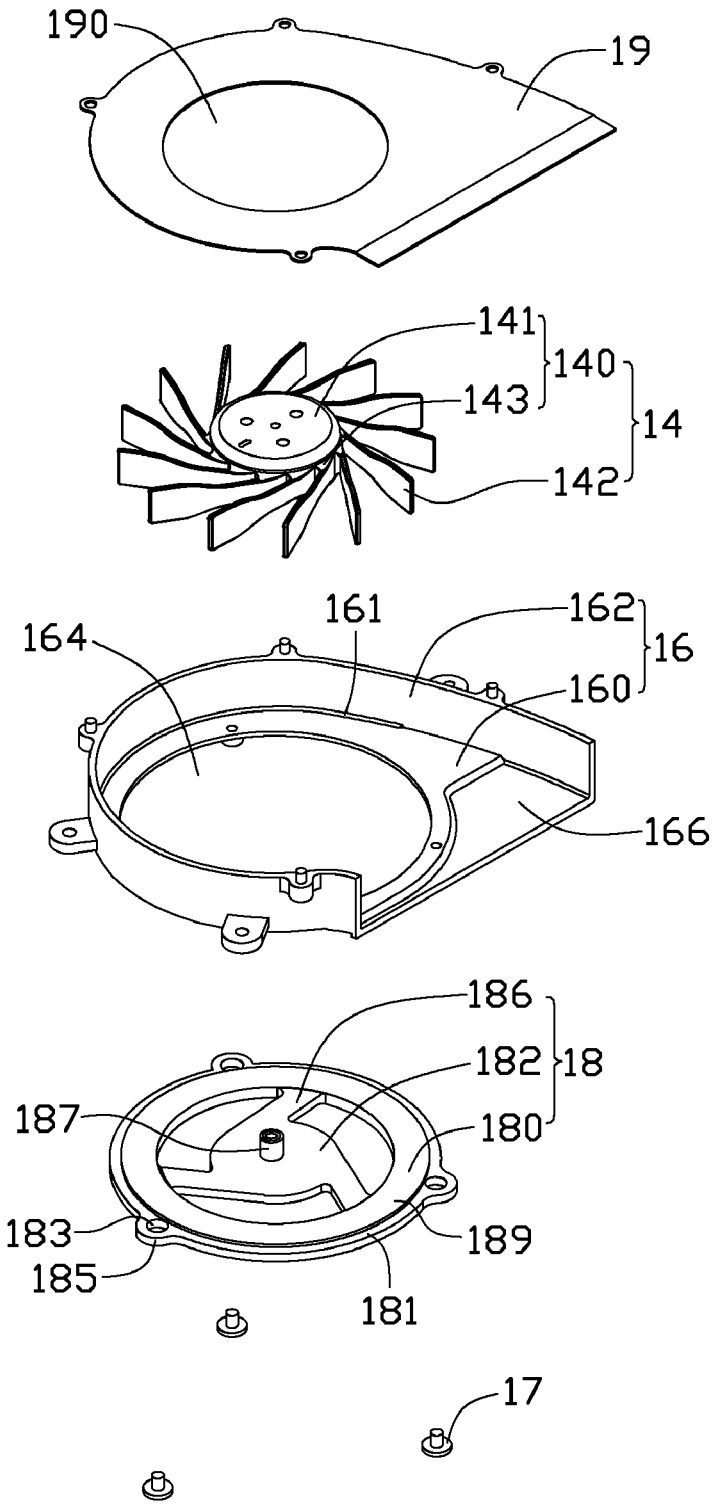
FIG. 2 is an exploded view of the centrifugal fan of FIG. 1.
Figure 3:
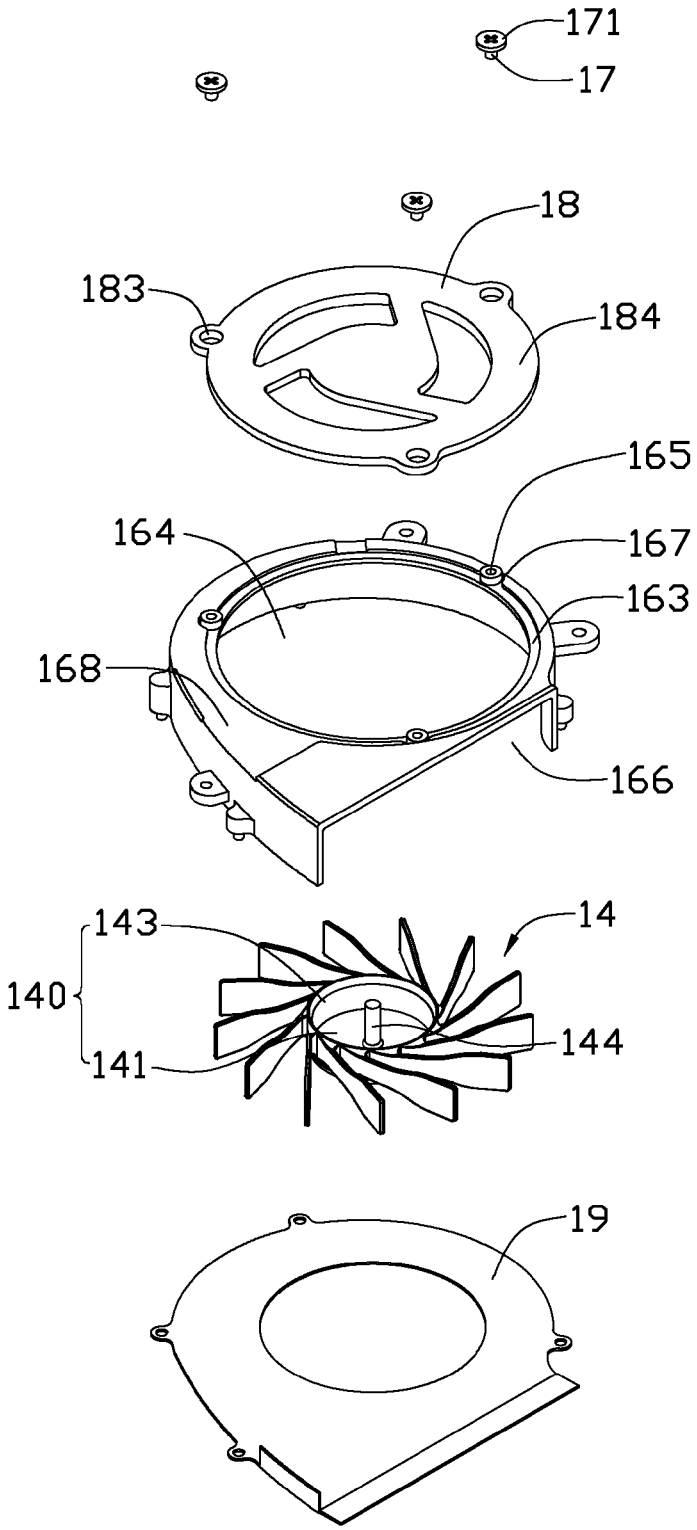
FIG. 3 is a view similar to FIG. 2, but viewed from another aspect.

Referring also to FIGS. 2 and 3, the housing 12 includes a bottom frame 16, a bracket 18 and a top cover 19.

The bottom frame 16 includes a bottom wall 160, and a volute sidewall 162 extending upwardly and perpendicularly from an outer periphery of the bottom wall 160. A first circular air inlet 164 is defined in a central portion of the bottom wall 160. A substantially rectangular air outlet 166 is defined in one lateral side of the sidewall 162. The bottom wall 160 and the sidewall 162 cooperatively define a space 161 for receiving the impeller 14 therein. An annular step 163 is formed around the first air inlet 164. The step 163 has a bottom surface higher than a bottom surface 168 of the bottom wall 160. A plurality of cylindrical protruding posts 167 are formed on the step 163, adjacent to the first air inlet 164. The protruding posts 167 are equally angularly spaced from each other around the first air inlet 164. Each of the protruding posts 167 extends downwardly and perpendicularly from the step 163. A bottom surface of each of the protruding posts 167 is lower than the bottom surface 168 of the bottom wall 160. A screw hole 165 is defined in each of the protruding posts 167. The screw hole 165 spans from a top surface of the bottom wall 160 to the bottom surface of the protruding post 167. That is, the screw hole 165 is a through hole. A screw thread is formed on an inner wall of each screw hole 165. The top cover 19 has a profile similar to that of the bottom wall 160, and covers on a top end of the sidewall 162. A second circular air inlet 190 is defined in a central portion of the top cover 19. A diameter of the second air inlet 190 is smaller than a diameter of the first air inlet 164.

The bracket 18 is located in the first air inlet 164 of the housing 12. The bracket 18 includes an annular chassis 182, a tube 187 extending upwardly and perpendicularly from a center of the chassis 182, an annular plate 180 concentric and spaced from the chassis 182, and a plurality of ribs 186 extending radially from an outer periphery of the chassis 182 to connect with an inner periphery of the annular plate 180. The annular plate 180 includes a planar bottom surface 184 and an opposite top surface 189. The annular plate 180 has an inner diameter substantially or approximately equal to the diameter of the second air inlet 190, and an outer diameter slightly larger than the diameter of the first air inlet 164. An outer portion of the top surface 189 of the annular plate 180 is lower than an inner portion of the top surface 189, to thereby form an annular connecting surface 181 at the outer portion of the top surface 189. The connecting surface 181 has a size and a shape corresponding to a size and a shape of the step 163 of the bottom wall 160. A distance between the connecting surface 181 and the bottom surface 184 of the annular plate 180 is substantially equal to a distance between the step 163 and the bottom surface 168 of the bottom wall 160.

A plurality of protruding tabs 185 extend outwardly from an outer periphery of the annular plate 180. The protruding tabs 185 are equally angularly spaced from each other around a periphery of the connecting surface 181. Each of the protruding tabs 185 is approximately semicircular shaped. A through hole 183 is defined in each of the protruding tabs 185. The through hole 183 has a diameter substantially equal to or equal to, an outer diameter of each of the protruding posts 167.

The impeller 14 includes a hub 140, and a plurality of blades 142 extending radially from the hub 140. The hub 140 includes a circular top plate 141, a shaft 144 extending downwardly and perpendicularly from a center of the top plate 141, and a cylindrical side plate 143 extending downwardly and perpendicularly from an outer periphery of the top plate 141. The blades 142 extend outwardly from an outer side surface of the side plate 143.

When the centrifugal fan 10 is assembled, the connecting surface 181 of the bracket 18 contacts the step 163 of the bottom wall 160 of the bottom frame 16, and the protruding posts 167 are respectively inserted into the through holes 183 of the protruding tabs 185. Thereby, the bracket 18 and the bottom frame 16 are attached together. The bottom surface 184 of the bracket 18 and the bottom surface 168 of the bottom frame 16 are coplanar. Then, a plurality of bolts (or screws) 17 are respectively screwed into the screw holes 165 of the protruding posts 167 along a bottom-to-top direction of the protruding posts 167. Each of the bolts 17 has a circular screw cap 171. A diameter of the screw cap 171 is larger than the diameter of the through hole 183 of the corresponding protruding tab 185. After the bolts 17 are entirely screwed into the screw holes 165 of the protruding posts 167, the screw caps 171 of the bolts 17 interferingly abut against a bottom surface of the protruding tabs 185 around the through holes 183, respectively, to thereby fixedly connect the bracket 18 and the bottom frame 16 together. The impeller 14 is mounted around the tube 187 of the bracket 18 via the shaft 144 being rotatably received in the tube 187. Then the cover 19 is connected to the top end of the side wall 162, with the second air inlet 190 just above the impeller 140.

Due to the presence of the protruding posts 167 formed on the bottom wall 160 of the bottom frame 16, a length of each of the screw holes 165 defined in the protruding posts 167 is not restrict to a thickness of the bottom wall 160. That is, an axial length of the screw thread formed on the inner wall of each of the protruding posts 167 can be much larger than the thickness of the bottom wall 160. Thus, a large portion of a screw thread of each bolt 17 can engage with a correspondingly large screw thread in the screw hole 165 of the a corresponding protruding post 167. Thereby, the bracket 18 and the housing 12 are fixed together more securely. Furthermore, the protruding posts 167 formed on the bottom surface 168 of the bottom wall 160 protrude to an outside of the centrifugal fan 10. The protruding posts 167 do not affect an airflow generated by the impeller 14 and flowing inside the centrifugal fan 10, thereby avoiding the generation of noise.

Figure 4:
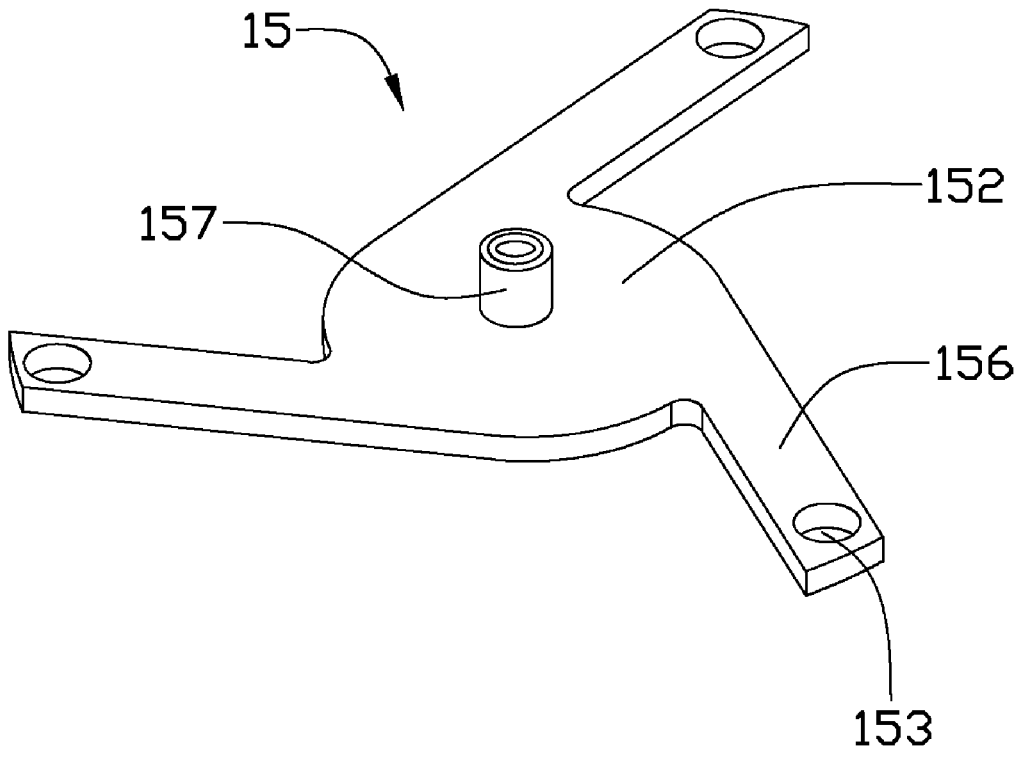
FIG. 4 is an isometric view of a bracket of a centrifugal fan according to a second embodiment.

FIG. 4 illustrates a bracket 15 of a centrifugal fan according to a second embodiment. The bracket 15 includes a circular chassis 152, a tube 157 extending upwardly and perpendicularly from a center of the chassis 152, and a plurality of ribs 156 extending radially from an outer periphery of the chassis 152. A through hole 153 is defined in a distal end of each of the ribs 156. The through hole 153 has a diameter substantially equal to the outer diameter of the protruding posts 167. When the centrifugal fan is assembled, the protruding posts 167 are firstly inserted into the through holes 153 of the ribs 156, respectively. Then the bolts 17 are screwed into the screw holes 165 of the protruding posts 167, with the screw caps 171 interferingly abutting against bottom surfaces of the ribs 156 around the through holes 153. Thereby, the bracket 15 and the bottom frame 16 are securely fixed together.

It is to be understood, however, that even though numerous characteristics and advantages of the embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A centrifugal fan comprising:

an impeller comprising a hub and a plurality of blades extending radially from the hub; and a housing receiving the impeller therein, the housing comprising a bottom wall, a sidewall extending upwardly from the bottom wall and a bracket for supporting the impeller thereon, the bottom wall defining an air inlet therein, a plurality of protruding posts extending downwardly from a bottom surface of the bottom wall around the air inlet, each of the protruding posts defining a screw hole therein, the bracket being located in the air inlet, the bracket defining a plurality of through holes corresponding to the protruding posts respectively, the protruding posts of the bottom wall respectively inserted into the through holes of the bracket, a plurality of fasteners respectively engaged in the screw holes of the protruding posts thereby connecting the bracket and the bottom wall together.

2. The centrifugal fan as described in claim 1, wherein a step is formed at an inner periphery of the bottom wall, the step being higher than a bottom surface of the bottom wall, the protruding posts being formed on the step and equally angularly spaced from each other around the air inlet.

3. The centrifugal fan as described in claim 2, wherein each of the screw holes spans from a top surface of the bottom wall to a bottom surface of the corresponding protruding post.

4. The centrifugal fan as described in claim 2, wherein the bracket comprises a chassis, a tube extending upwardly from the chassis, an annular plate around the chassis, and a plurality ribs connecting the chassis with the annular plate, the through holes being defined in the annular plate.

5. The centrifugal fan as described in claim 4, wherein the annular plate has a planar bottom surface and a top surface, an outer portion of the top surface of the annular plate is lower than an inner portion of the top surface of the annular plate, the outer portion of the top surface contacts the step of the bottom wall, and the bottom surface of the annular plate is coplanar with the bottom surface of the bottom wall.

6. The centrifugal fan as described in claim 4, wherein the housing further comprises a cover defining another air inlet therein, a diameter of the air inlet of the cover being smaller than a diameter of the air inlet of the bottom wall, the annular plate of the bracket having an inner diameter approximately equal to the diameter of the air inlet of the cover and an outer diameter larger than the diameter of the air inlet of the bottom wall.

7. The centrifugal fan as described in claim 1, wherein the bracket comprises a chassis, a tube extending upwardly from the chassis and a plurality of ribs extending radially from chassis, the through holes being defined in distal ends of the ribs, respectively.

8. The centrifugal fan as described in claim 1, wherein a diameter of each of the through holes is substantially equal to an outer diameter of each of the protruding posts.

9. A centrifugal fan comprising:

an impeller comprising a hub and a plurality of blades extending radially from the hub; and a housing comprising a bottom wall defining an air inlet therein, a bracket arranged in the air inlet, and a plurality of fasteners fixing the bracket onto the bottom wall, the bottom wall comprising a plurality of protruding posts extending downwardly from a bottom surface thereof, each of the protruding posts defining a screw hole therein, the bracket defining a plurality of through holes with the protruding posts respectively extending therethrough, each of the fasteners threadedly engaging into one corresponding screw hole with a head cap of each fastener interferingly abutting the bracket at a position around the corresponding through hole.

10. The centrifugal fan as described in claim 9, wherein the bracket comprises a chassis, a tube extending upwardly from the chassis, an annular plate around the chassis and a plurality of ribs interconnecting the chassis and the annular plate, the plurality of through holes being defined in the annular plate.

11. The centrifugal fan as described in claim 10, wherein a step is formed at an inner periphery of the bottom wall higher than a bottom surface of the bottom wall, the annular plate comprising a planar bottom surface coplanar with the bottom surface of the bottom wall and an opposite top surface abutting the step.

12. The centrifugal fan as described in claim 11, wherein an outer portion of the top surface of the annular plate is lower than an inner portion of the top surface of the annular plate, the through holes each extending through the annular plate from the bottom surface of the annular plate to the outer portion of the top surface of the annular plate, the step just contacting the outer portion of the top surface.

13. The centrifugal fan as described in claim 9, wherein the bracket comprises a chassis, a tube extending upwardly from the chassis and a plurality of ribs extending radially from chassis, the through holes being defined in distal ends of the ribs, respectively.

14. The centrifugal fan as described in claim 9, wherein a diameter of each of the through hole equals to an outer diameter of the corresponding protruding post.

* * * * *